US007611344B2

(12) United States Patent
Ni

(10) Patent No.: US 7,611,344 B2
(45) Date of Patent: Nov. 3, 2009

(54) SEALING TABS ON ORBITING SCROLL

(75) Inventor: Shimao Ni, Bolingbrook, IL (US)

(73) Assignee: Scroll Laboratories, Inc., Bolingbrook, IL (US)

( * ) Notice: Subject to any disclaimer, the term of this patent is extended or adjusted under 35 U.S.C. 154(b) by 0 days.

(21) Appl. No.: 11/872,237

(22) Filed: Oct. 15, 2007

(65) Prior Publication Data

US 2009/0098001 A1 Apr. 16, 2009

(51) Int. Cl.
*F04C 18/00* (2006.01)
*F04C 2/00* (2006.01)

(52) U.S. Cl. ..... 418/55.5; 418/57; 418/104

(58) Field of Classification Search ..... 418/55.1–55.6, 418/57, 104
See application file for complete search history.

(56) References Cited

U.S. PATENT DOCUMENTS

| | | | | | |
|---|---|---|---|---|---|
| 2,941,853 | A | | 6/1960 | Bartholomaus | |
| 3,011,694 | A | | 12/1961 | Audemar | |
| 4,990,071 | A | | 2/1991 | Sugimoto | |
| 5,193,992 | A | | 3/1993 | Terauchi | |
| 5,588,820 | A | * | 12/1996 | Hill et al. | 418/55.4 |
| 5,613,841 | A | * | 3/1997 | Bass et al. | 418/55.5 |
| 5,755,564 | A | | 5/1998 | Machida et al. | |
| 5,833,442 | A | * | 11/1998 | Park et al. | 418/55.5 |
| 6,077,057 | A | | 6/2000 | Hugenroth et al. | |
| 6,146,119 | A | | 11/2000 | Bush et al. | |
| 6,149,413 | A | | 11/2000 | Lifson | |
| 6,186,754 | B1 | | 2/2001 | Sakai et al. | |
| 6,224,059 | B1 | | 5/2001 | Sun | |
| 6,331,102 | B1 | | 12/2001 | Takeuchi et al. | |
| 6,758,659 | B2 | | 7/2004 | Ni | |
| 6,969,243 | B1 | | 11/2005 | Lifson et al. | |
| 2007/0172373 | A1 | | 7/2007 | Ni | |

FOREIGN PATENT DOCUMENTS

| | | | |
|---|---|---|---|
| JP | 05087129 | | 4/1993 |
| JP | 6-058269 | A | 10/1996 |
| JP | 2003-021084 | A | 1/2003 |
| JP | 2004-108339 | A | 4/2004 |
| JP | 2004-124906 | A | 4/2004 |

OTHER PUBLICATIONS

International Search Report, dated Feb. 26, 2009, from corresponding International Patent application PCT/US2008/075801.
Written Opinion of the International Searching Authority, dated Feb. 26, 2009, from corresponding International Patent Application PCT/US2008/075801.

* cited by examiner

*Primary Examiner*—Theresa Trieu
(74) *Attorney, Agent, or Firm*—Hamre, Schumann, Mueller & Larson, P.C.

(57) ABSTRACT

An improved sealing mechanism for a positive fluid displacement apparatus, where sealing tabs are located on the orbiting scroll. The sealing tabs can be integrally formed with the orbiting scroll or disposed on a piston that is mounted on the orbiting scroll.

7 Claims, 5 Drawing Sheets

SEALING TABS ON ORBITING SCROLL

FIELD

This disclosure relates to a positive fluid displacement apparatus and more particularly to a positive fluid displacement apparatus having an improved sealing mechanism.

BACKGROUND

There is known in the art a class of devices generally referred to as "scroll" vacuum pumps, compressors and expanders, together referred to as positive fluid displacement apparatus, wherein two interfitting spiroidal or involute spiral elements are conjugate to each other and are mounted on separate end plates forming what may be termed as fixed and orbiting scrolls. These elements are interfitted to form line contacts between spiral elements.

A pair of adjacent line contacts and the surfaces of end plates form at least one sealed off pocket. When one scroll, i.e. the orbiting scroll, makes relative orbiting motion, i.e. circular translation, with respect to the other, the line contacts on the spiral walls move along the walls and thus changes the volume of the sealed off pocket. The volume change of the pocket will expand or compress the fluid in the pocket, depending on the direction of the orbiting motion. When the volume change of the pocket compresses the fluid in the pocket, a pressure is created inside the pocket such that a separating force in the axial direction is generated between the fixed and orbiting scrolls. This phenomenon can cause low machine efficiency.

Referring to U.S. Pat. No. 6,224,059, there is a scroll type compressor in which two separate seal structures are provided. The seal structures are positioned radially inward and outward behind the orbiting scroll member so as to create a chamber. The chamber is allowed to receive pressurized gas, which generates a back pressure force.

The seal structure includes a seal jacket having a rear wall and inwardly extending lips, and a coil spring positioned inside the seal jacket. The coil spring, together with the pressurized gas that is leaked into the chamber, provides a back pressure force that forces the lip to press against the rear surface of the orbiting scroll. However, the high contact force against the lip seal can lead to undue wearing of the seal.

U.S. Pat. No. 6,224,059 discloses a seal structure that is further provided with a sheet on the lip facing the orbiting scroll. The surface of the sheet is provided with a tab extending outwardly toward the orbiting scroll. The tab provides a contact area for the rear surface of the orbiting scroll. The tab reduces the total contact force experienced between the seal and the rear surface of the orbiting scroll by reducing the force imbalance due to the pressure gradient along the lip. However, in practice, it does not take long for frictional wear of the sealing tabs, especially in scroll compressors with an oil-free design, to render the sealing tabs ineffective.

SUMMARY

An improved sealing mechanism for a positive fluid displacement apparatus, for example a compressor, vacuum pump, or expander, where seals for the positive fluid displacement apparatus are located on the orbiting scroll and, in some embodiments, utilized with a spring energized moving piston.

In one embodiment, a positive fluid displacement apparatus utilizing the improved sealing mechanism has an orbiting scroll with an orbiting moving piston which can orbit together with the orbiting scroll. The moving piston is provided with a pair of sealing tabs and a plurality of springs which enables sealing contact between the sealing tabs and a base thrust plate. A front plenum is formed between the back surface of the orbiting scroll and the moving piston and sealed off by a pair of "O" rings, or sealing elements. A back plenum is formed between the orbiting moving piston and a base thrust plate and sealed off by the pair of sealing tabs. During operation, a discharged pressure from a compression chamber is released into the front plenum, thereby urging the orbiting scroll towards the fixed scroll. When the discharged pressure from the front plenum is released into the back plenum, the forces generated on the orbiting moving piston by the discharged pressure in the front and back plenums are substantially balanced.

In another embodiment, the positive fluid displacement apparatus utilizing the improved sealing mechanism has a non-orbiting axially moving piston. The orbiting scroll has sealing tabs extending from the back surface of the orbiting scroll. The working principle for this embodiment is the same as that of the above embodiment.

DETAILED DESCRIPTION

An improved sealing mechanism for a positive fluid displacement apparatus is achieved by providing sealing tabs on the orbiting scroll. The positive fluid displacement apparatus can be, for example, a compressor, vacuum pump, or expander. For sake of convenience, the following description will describe the positive fluid displacement apparatus as being a compressor. Without being bound to theory, one of the advantages of the improved sealing mechanism is explained as follows.

Figure 1B:
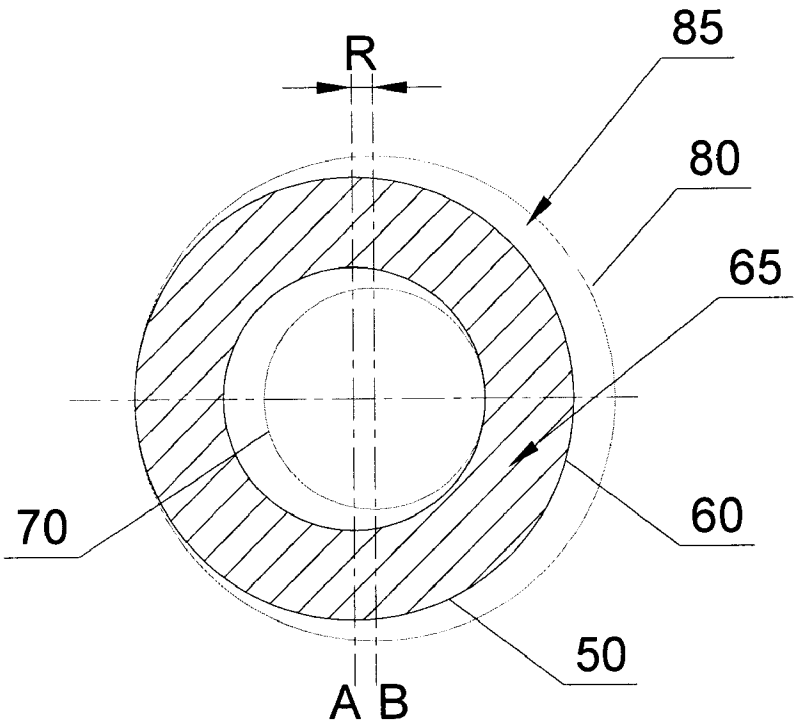
FIGS. 1A and 1B illustrate examples of different plenum areas at the back surface of an orbiting scroll.
Figure 1A:
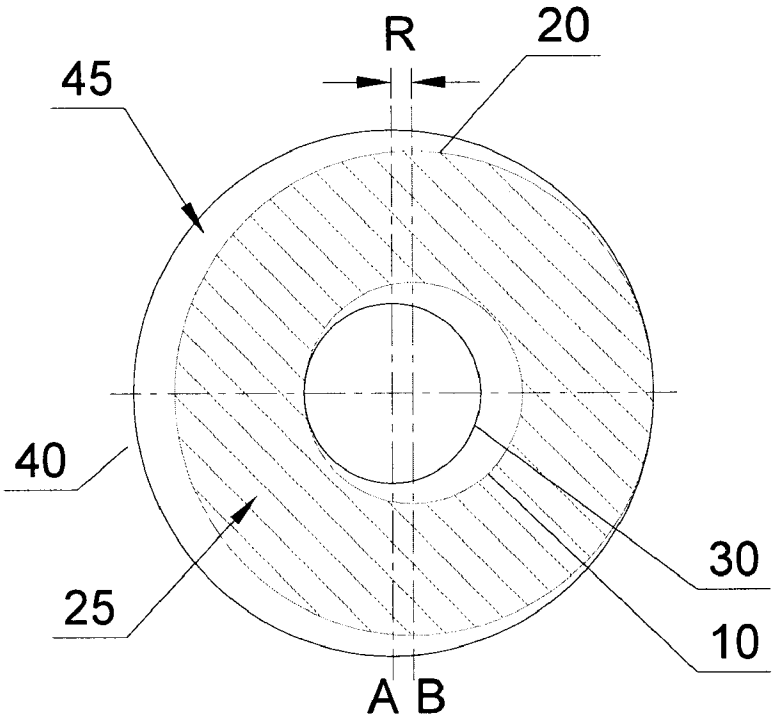

Referring to FIG. 1A, the outer diameters of a bearing hub and an orbiting scroll end plate are represented by an inner circle 10 and an outer circle 20, respectively. The area 25 between the inner and outer circles 10 and 20 represents the maximum possible plenum area on the back surface of an orbiting scroll using sealing tabs on the orbiting scroll. An area 45 between an inner circle 30 and outer circle 40 represents a fixed sealing plate. The distance R between vertical axis A and vertical axis B represents an orbiting radius. If the sealing tabs are provided along the outer diameters of inner circle 10 and outer circle 20, the maximum plenum area 25 on the back surface of the orbiting scroll as shown in FIG. 1A can be achieved.

On the other hand, if the sealing tabs are not provided on the orbiting scroll but behind the orbiting scroll member as described in U.S. Pat. No. 6,224,059, the maximum plenum area is confined to a smaller area. That is, as shown in FIG. 1B, when the sealing tabs are provided behind the orbiting scroll member, the boundary of the orbiting scroll for sealing (represented by the area 85 between inner circle 70 and outer circle 80) is limited as compared to when the sealing tabs are provided on the orbiting scroll, thereby limiting the plenum area 65 on the back surface of the orbiting scroll (represented by the area between the inner circle 50 and outer circle 60). This principle can be generally understood from the fact that if the orbiting scroll orbited beyond the plenum area 65, then the sealing tabs would lose their sealing function.

The sealing tabs of the present disclosure providing an improved sealing mechanism is described, for example, in the following embodiments.

Figure 2:
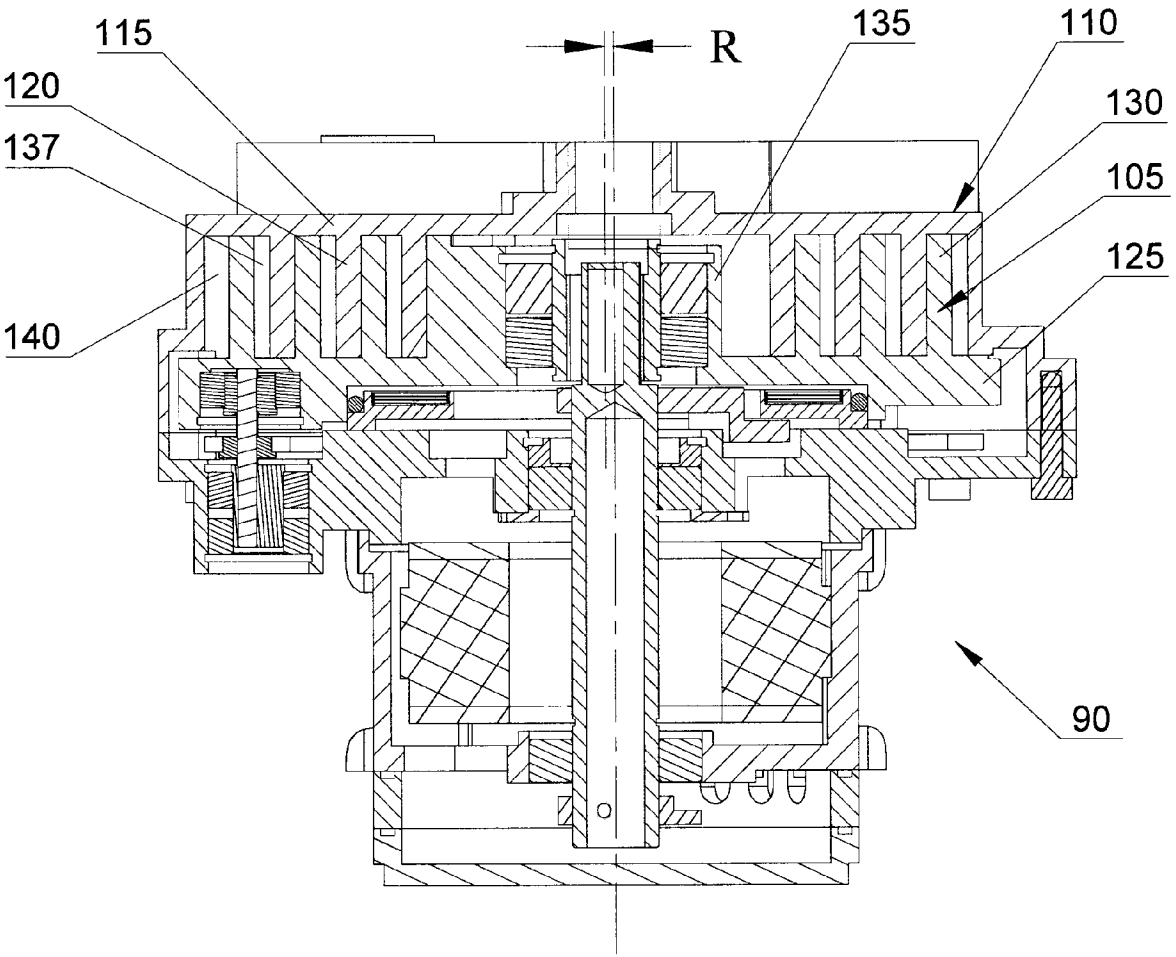
PRIOR ART Figure 2
FIG. 2 is a cross-sectional view of a positive fluid displacement apparatus with an orbiting moving piston seal mechanism.

Referring to FIG. 2, a positive fluid displacement apparatus 90 that can be used to implement the sealing tabs of the improved sealing mechanism is shown. The positive fluid displacement apparatus 90 has an orbiting scroll 105 interfitted with a fixed scroll 110. The fixed scroll 110 includes an end plate 115 from which a scroll element 120 extends. The orbiting scroll 105 includes a circular end plate 125, a scroll element 130 extending from the end plate 125 and orbiting bearing hub 135 affixed to and extending from the central portion of the end plate 125. The scroll elements 120 and 130 are interfitted at a 180 degree offset, and at a radial offset R. At least one sealed off compression chamber 137 is thereby defined between the scroll elements 120 and 130 and end plates 115 and 125.

Figure 3:
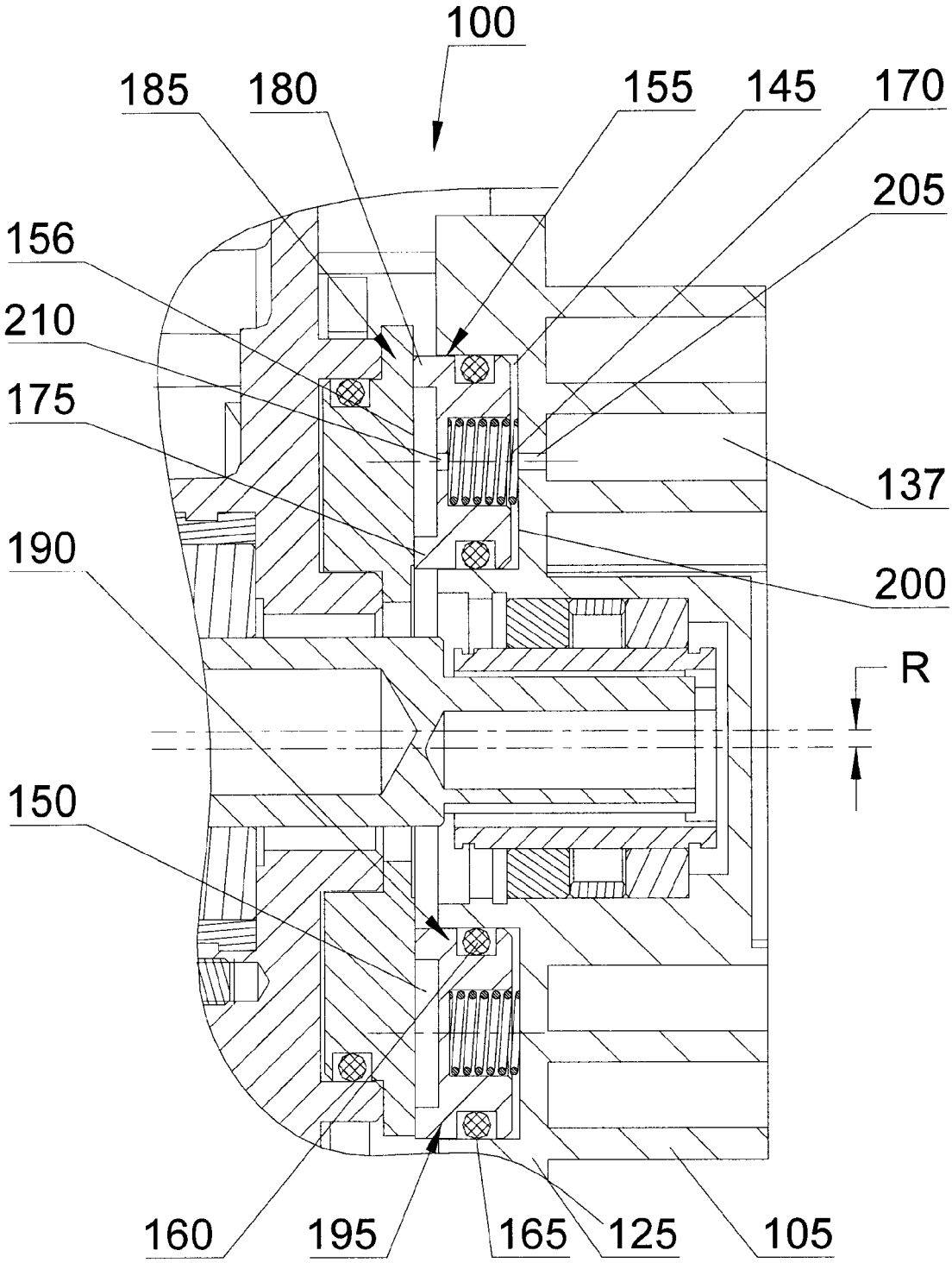
FIG. 3 is a cross-sectional view of an orbiting moving piston seal mechanism, where the orbiting moving piston is provided with a pair of sealing tabs pressing against a base thrust plate.

Referring to FIG. 3, a positive fluid displacement apparatus 100 is provided with an orbiting moving piston seal mechanism for sealing off front and back plenums 145 and 150 from an air passage 140 (not shown). The orbiting moving piston seal mechanism comprises an orbiting moving piston 155, inner and outer "O" rings 160 and 165, springs 170 and inner and outer sealing tabs 175 and 180. The orbiting Moving piston 155 is energized by the springs 170 and air at discharge pressure P in the plenums 145 and 150.

The orbiting moving piston 155 includes the inner and outer sealing tabs 175 and 180. The tabs 175, 180 extend for at least a portion of the radial thickness of the orbiting moving piston 155, and the tabs 175, 180 extend toward a front side 156 of a back plate 185. In the illustrated embodiment, the inner and outer sealing tabs 175, 180 are spaced apart substantially the entire radial thickness of the piston 155 so that the tabs line the inner and outer edges 190, 195 of the orbiting moving piston 155. The moving piston 155 is supported on the end plate 125 of the orbiting scroll 105, and is mounted so that it can move axially relative to the end plate 125 and can orbit together with the orbiting scroll 105 in contact with the back plate 185.

The inner and outer "O" rings 160 and 165 are provided in between the inner and outer sealing tabs 175, 180 and the orbiting end plate 125. The rings 160, 165 extend for a portion of the radial thickness of the orbiting moving piston 155. The inner "O" ring 160 radially flanks the inner diameter of the springs 170 and the outer "O" ring 165 radially flanks the outer diameter of the springs 170. The rings 160, 165 seal off the front plenum 145 from the air passage 140 (not shown).

The inner and outer diameters of the front plenum 145 are so sized that the force acting on the back surface 200 of the end plate 125 of the orbiting scroll 105 in the front plenum 145 by pressurized air introduced into the plenum 145 slightly exceeds the total axial separating force acting on the tips and bases of the orbiting scroll 105 by the compressed air during operation. The net axial force urges the orbiting scroll 105 towards the fixed scroll to achieve light contact between the tip surfaces of one scroll against the mating base surface of the mating scroll.

The springs 170 are appropriately sized to force piston 155 toward the back plate 185 such that the sealing tabs 175, 180 engage against the back plate 185. The back plenum 150 is formed between the orbiting moving piston 155 and back plate 185 and sealed off by the sealing tabs 175, 180. The inner and outer diameters of the back plenum 150 are so sized that the pressurized force of the discharge air in the front and back plenums 145 and 150 are substantially balanced during operation.

A first bleeding hole 205 is provided in the end plate 125 to place the front plenum 145 in communication with the compression chamber 137. A second bleeding hole 210 is provided in the piston 155 to place the back plenum 150 in communication with the front plenum 145. The bleeding holes 205 and 210 provide fluid communication between the chamber 137 and the front and back plenums 145 and 150, to introduce the pressurized fluid into the plenum 145, and to achieve pressure balance between the plenums 145, 150.

During operation, gas is compressed in the compression chamber 137, and the chamber 137 is pressurized by air at discharge pressure P. The first bleeding hole 205 introduces pressurized gas at discharge pressure P from the compression chamber 137 to the front plenum 145. When the pressurized gas enters the front plenum 145, the discharge pressure P acting on the back surface 200 of the orbiting scroll 105 in the front plenum 145 urges the orbiting scroll 105 towards the fixed scroll 110. The second bleeding hole 210 introduces the pressurized gas at pressure P to the back plenum 150 formed between the orbiting moving piston 155 and back plate 185 and sealed off by sealing tabs 175,180, to balance the forces generated by the pressurized gas on opposite sides of the piston 155 in the plenums 145, 150.

Figure 4:
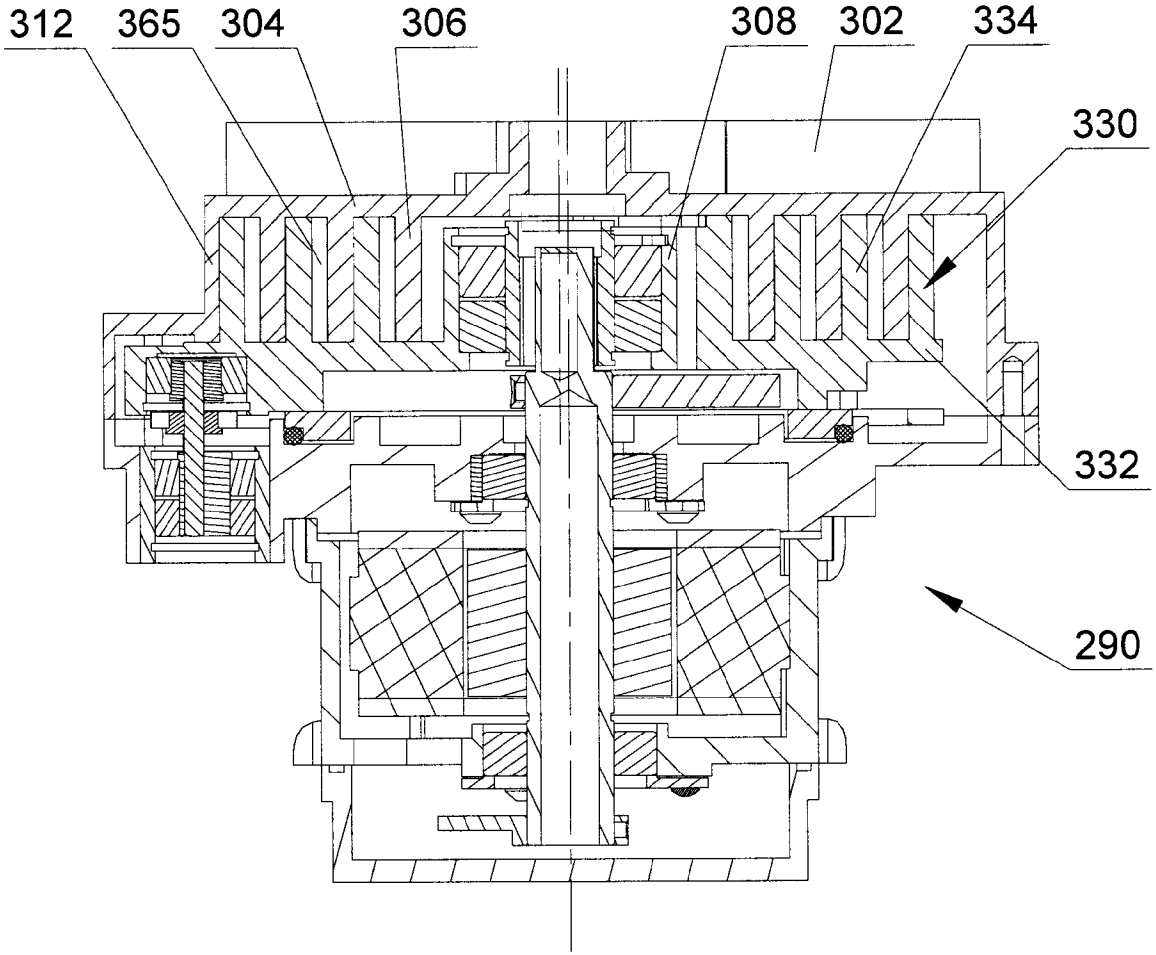
PRIOR ART Figure 4
FIG. 4 is a cross-sectional view of a positive fluid displacement apparatus with a non-orbiting, axially moving piston seal mechanism.

Referring to FIG. 4, another positive fluid displacement apparatus 290 that can be used to implement the sealing tabs of the improved sealing mechanism is shown. The positive fluid displacement apparatus 290 has an orbiting scroll 330 interfitted with a fixed scroll 302. The fixed scroll 302 includes an end plate 304 from which a scroll element 306 extends. The orbiting scroll 330 includes a circular end plate 332, a scroll element 334 extending from the end plate 332 and orbiting bearing hub 308 affixed to and extending from the central portion of the end plate 332. The scroll elements 334 and 306 are interfitted at a 180 degree offset, and at a radial offset R. At least one sealed off compression chamber 365 is thereby defined between the scroll elements 334 and 306 and end plates 332 and 304.

Figure 5:
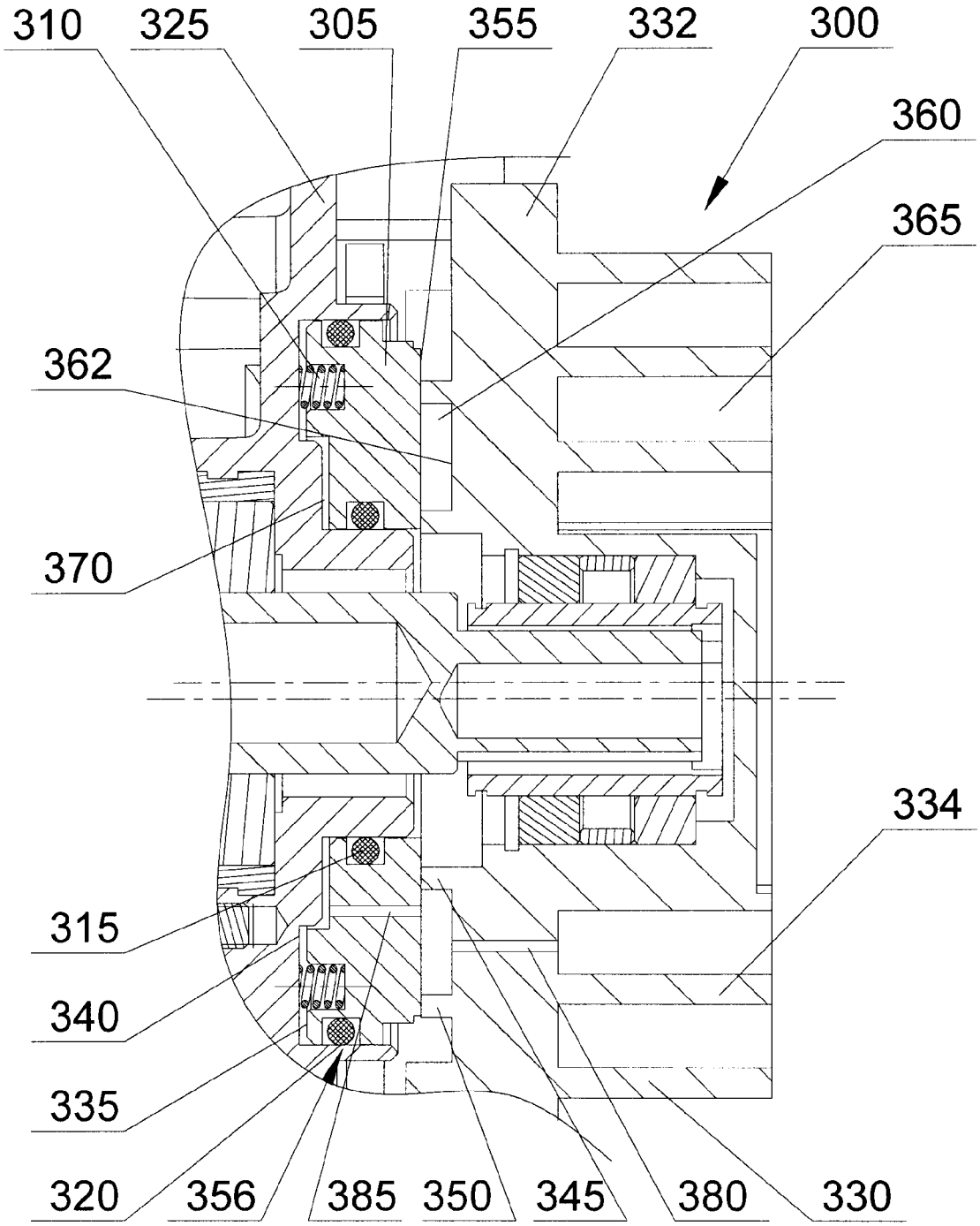
FIG. 5 is a cross-sectional view of a non-orbiting, axially moving piston, where a pair of sealing tabs extends from the surface of the end plate of the orbiting scroll.

Referring to FIG. 5, a positive fluid displacement apparatus 300 is provided with a non-orbiting, axially moving piston seal mechanism for sealing off front and back plenums 360 and 370 from an air passage 312 (not shown). The non-orbiting, axially moving piston seal mechanism includes an axially moving piston 305, springs 310 which can be, for example, coil springs, wave springs or other type of springs, and inner and outer "O" rings 315, 320. The axially moving piston 305 is energized by the springs 310, and air at discharge pressure P introduced into the plenums 360 and 370. The axially moving piston 305 is provided within a fixed base housing 325 and is non-orbiting such that the axially moving piston 305 does not orbit together with the orbiting scroll 330. The base housing 325 together with the axially moving piston 305 form a back plate 356.

The non-orbiting, axially moving piston seal mechanism also includes inner and outer sealing tabs 345, 350. The sealing tabs 345, 350 extend for at least a portion of the radial thickness of the orbiting scroll 330 and extend from the orbiting scroll 330 toward a front side 355 of the axially moving piston 305. The front plenum 360 is formed between the axially moving piston 305 and the orbiting scroll 330 and sealed off by the inner and outer sealing tabs 345, 350. The inner and outer diameters of the front plenum 360 are so sized that the force acting on the back surface 362 of the orbiting scroll 330 in the front plenum 360 by pressurized air slightly exceeds the total axial separating force acting on the tips and bases of the orbiting scroll 330 by the compressed air during operation. The net axial force urges the orbiting scroll 330 towards the fixed scroll to achieve light contact between the tip surfaces of one scroll against the mating base surface of the mating scroll.

The springs 310 are sized so that they urge the front side 355 of the moving piston 305 axially into contact with the sealing tabs 345, 350. The back plenum 370 is formed between a back side 340 of the base housing 325 and the moving piston 305. The back plenum 370 is sealed off by the inner and outer "O" rings 315, 320. The inner and outer diameters of the back plenum 370 are so sized that the forces caused by the pressurized air in the front and back plenums 360 and 370 are substantially balanced during operation.

A first bleeding hole 380 is provided between the compression chamber 365 and the front plenum 360, and a second bleeding hole 385 is provided between the front plenum 360 and the back plenum 370. The bleeding holes 380, 385 provide fluid communication between the chamber 365 and the front and back plenums 360 and 370.

During operation, gas is compressed in the compression chamber 365, and the chamber 365 is pressurized by air at discharge pressure P. The first bleeding hole 380 introduces pressurized gas at discharge pressure P from the compression chamber 365 to the front plenum 360. The second bleeding hole 385 then further introduces the pressurized gas at discharge pressure P to the back plenum 370 formed between the back side 340 of the base housing 325 and the back surface 335 of the moving piston 305. When the pressurized gas enters the back plenum 370, the pressure acting on the back surface 335 of the moving piston 305 together with the spring force by springs 310 urges the moving piston 305 towards the inner and outer sealing tabs 345, 350. The forces generated by the discharge pressure on both sides of the moving piston 305 are then substantially balanced.

While the above-described embodiments of the improved sealing mechanism are preferred, those skilled in this art will recognize modification, structure, arrangement, composition and the like which do not part from the true scope of the disclosure. The invention is defined by the appended claims, and all devices and/or methods that come within the meaning of the claims, either literally or by equivalents, are intended to be embraced therein.

What is claimed is:

1. A positive fluid displacement apparatus, comprising:

a) a back plate;

b) at least one orbiting scroll member having a first end plate with a first side and a second side, and a first involute wrap affixed to the first side;

c) at least one stationary scroll member with a second end plate having a second involute wrap affixed thereto, the second involute wrap being engaged with the first involute wrap of the orbiting scroll member;

d) a rotatable shaft arranged to drive the orbiting scroll member in orbiting motion with respect to the stationary scroll member;

e) inner and outer sealing tabs fixed to the at least one orbiting scroll member on the second side thereof so that the inner and outer sealing tabs orbit with the at least one orbiting scroll member, the sealing tabs are spaced from each other in a radial direction and extend away from the first end plate toward the back plate;

f) the back plate includes a sealing piston disposed thereon; a plurality of springs engaged with the sealing piston and biasing the sealing piston toward the orbiting scroll member so that the sealing piston is engaged with the sealing tabs; and a bleeding hole formed through the sealing piston providing fluid communication between a front side of the sealing piston and a back side thereof.

2. A positive fluid displacement apparatus in accordance with claim 1, wherein the sealing tabs are integrally formed with the first end plate.

3. A positive fluid displacement apparatus in accordance with claim 1, wherein at least one plenum chamber is formed at the second side of the first end plate, at least one bleeding hole is formed in the first end plate to place the first side of the first end plate in fluid communication with the at least one plenum chamber at the second side of the first end plate, so that upon introduction of a pressurized fluid into the at least one plenum chamber the orbiting scroll member is urged towards the stationary scroll member.

4. A positive fluid displacement apparatus in accordance with claim 3, wherein the at least one plenum is formed between the first end plate and the front side of the sealing piston and sealed by the inner and outer sealing tabs.

5. A positive fluid displacement apparatus in accordance with claim 1, further comprising a plurality of sealing elements mounted on the sealing piston.

6. A positive fluid displacement apparatus, comprising:

an orbiting scroll member having a first end plate with a first side and a second side, and a first involute wrap affixed to the first side;

a stationary scroll member with a second end plate having a second involute wrap affixed thereto, the second involute wrap being engaged with the first involute wrap of the orbiting scroll member;

a rotatable shaft arranged to drive the orbiting scroll member in orbiting motion with respect to the stationary scroll member;

the orbiting scroll member including inner and outer sealing tabs on the second side thereof that orbit with the orbiting scroll member, the sealing tabs are spaced from each other in a radial direction and extend in a direction away from the stationary scroll member;

a sealing piston disposed on a housing;

a plurality of springs engaged between the housing and the sealing piston and biasing the sealing piston toward the orbiting scroll member so that the sealing piston is engaged with the sealing tabs, and a plenum is defined by the sealing tabs, a front side of the sealing piston and a surface of the first end plate;

a bleeding hole formed through the sealing piston that provides fluid communication between the plenum and a back side of the sealing piston; and an additional bleeding hole formed through the first end plate that places the first side of the first end plate in fluid communication with the plenum.

7. A positive fluid displacement apparatus in accordance with claim 6, wherein the sealing tabs are integrally formed with the first end plate.

* * * * *